US007476481B2

(12) United States Patent
Fujino et al.

(10) Patent No.: US 7,476,481 B2
(45) **Date of Patent: *Jan. 13, 2009**

(54) ELECTROSTATIC CHARGE IMAGE DEVELOPING TONER AND PRODUCTION PROCESS FOR THE SAME

(75) Inventors: Yasumitsu Fujino, Akishima (JP); Hideaki Ueda, Kishiwada (JP); Seishi Ojima, Hachioji (JP); Fumie Motoori, Otsushi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 382 days.

This patent is subject to a terminal disclaimer.

(21) Appl. No.: 10/981,536

(22) Filed: Nov. 5, 2004

(65) Prior Publication Data

US 2005/0100809 A1 May 12, 2005

(30) Foreign Application Priority Data

Nov. 10, 2003 (JP) ..... 2003-379810

(51) Int. Cl.
*G03G 9/093* (2006.01)

(52) U.S. Cl. ..... 430/110.2; 430/137.11; 430/137.14

(58) Field of Classification Search ..... 430/110.2, 430/137.14, 137.11
See application file for complete search history.

(56) References Cited

U.S. PATENT DOCUMENTS

| | | | | |
|---|---|---|---|---|
| 5,346,790 | A * | 9/1994 | Sacripante et al. | 430/110.2 |
| 5,565,293 | A * | 10/1996 | Akiyama et al. | 430/110.2 |
| 5,935,753 | A * | 8/1999 | Ohishi et al. | 430/110.4 |
| 6,617,091 | B2 * | 9/2003 | Nishimori et al. | 430/137.11 |
| 2001/0033982 | A1 | 10/2001 | Ishikawa et al. | |
| 2002/0039699 | A1 | 4/2002 | Nishimori et al. | |
| 2004/0115550 | A1 * | 6/2004 | Sugiura et al. | 430/109.4 |
| 2005/0064314 | A1 * | 3/2005 | Fujino et al. | 430/110.2 |

FOREIGN PATENT DOCUMENTS

| | | |
|---|---|---|
| JP | 2001-324834 | 11/2001 |
| JP | 2002-82487 | 3/2002 |
| JP | 2002-082490 | 3/2002 |
| JP | 2002-116574 | 4/2002 |
| JP | 2002-156781 | 5/2002 |
| JP | 2002-351139 | 12/2002 |

OTHER PUBLICATIONS

Notification of Reasons for Refusal Issued in corresponding Japanese Patent Application No. 2003-379810, and translation thereof.

* cited by examiner

*Primary Examiner*—Mark F Huff
*Assistant Examiner*—Rachel L Burney
(74) *Attorney, Agent, or Firm*—Buchanan Ingersoll & Rooney PC

(57) ABSTRACT

An electrostatic charge image developing toner comprises core particles formed by flocculating and fusion-bonding at least polyester resin particles containing wax and colorant particles, and a coating layer containing a resin formed over the core particles.

13 Claims, No Drawings

ELECTROSTATIC CHARGE IMAGE DEVELOPING TONER AND PRODUCTION PROCESS FOR THE SAME

RELATED APPLICATION

The present invention is based on Japanese Patent Application No. 2003-379810, the content of which is incorporated by reference.

BACKGROUND OF THE INVENTION

1. Field of the Invention

The present invention relates to an electrostatic charge image developing toner and a production process for the same, the electrostatic charge image developing toner used for developing an electrostatic image formed on a photosensitive member provided in an image forming apparatus such as copiers and printers. More particularly, the invention relates to an electrostatic charge image developing toner which includes core particles containing at least a resin and a colorant and coated with a resin coating layer, and to a process for producing the same.

2. Description of the Related Art

The image forming apparatuses such as copiers and printers have conventionally used electrostatic charge image developing toners for developing an electrostatic image formed on the photosensitive member.

A milling process is widely used for producing such an electrostatic charge image developing toner. The process includes the steps of: admixing additives including a colorant, a wax and the like to a resin; melting the mixture by heating and kneading the molten mixture; cooling the kneaded product; and milling the product into toner particles of a predetermined particle size.

Unfortunately, in a case where the electrostatic charge image developing toner is produced by the milling process, the produced electrostatic charge image developing toner has various problems such as great variations of particle size, poor productivity, and high production costs. In a case where a toner of a small particle size is produced, in particular, a yield is seriously decreased.

More recently, therefore, an emulsion polymerization/flocculation method has been proposed as a production method of an electrostatic charge image developing toner which allows for arbitrary control of the toner particle configuration or of toner particle size distribution.

Where the electrostatic charge image developing toner is produced by the aforesaid emulsion polymerization/flocculation method, the following procedure may be taken. A dispersion of resin particles is prepared by emulsion polymerization. On the other hand, a dispersion of colorant particles is prepared, while a dispersion of wax to be used as a release agent is prepared. These dispersions are blended together and stirred while a suitable flocculating agent such as an inorganic metal salt is added to the dispersion mixture so as to allow the above resin particles, colorant particles and such to flocculate together. Subsequently, the resultant flocculate is fusion-bonded by heating and thus is produced the toner.

Where the electrostatic charge image developing toner is produced in this manner, however, the colorant or the wax and such is not dispersed equally, then, the colorant, the wax and such are flocculated and exposed to the toner surface, resulting that the toner is lowered in fixing performance and stability to environment. Hence, the toner is varied in electric charge due to the environmental changes, so that formed images may suffer density variations or fogging. Furthermore, in the case of color image formation, formed images may suffer color tone changes.

More recently, there have been proposed an electrostatic charge image developing toner prepared by depositing or fixing resin fine particles to particle aggregates containing at least polymer primary particles and a coloring agent wherein the polymer primary particles contain wax (Japanese Unexamined Patent Publication No. 2002-82487) and a toner wherein surface of pigment dispersion dispersed between main resins is coated with a resin coating layer having a charge control agent dissolved and the pigment dispersion contains wax (Japanese Unexamined Patent Publication No. 2002-82490).

The aforesaid toners can prevent the wax from being exposed to the surface thereof, however, on the other hand, the toners still have a problem that a fine dispersion of the wax therein is difficult and therefore, improvements in fixing performance can not be accomplished sufficiently.

SUMMARY OF THE INVENTION

The invention is directed to provide at least a new electrostatic charge image developing toner used for developing the electrostatic image formed on the photosensitive member of the image forming apparatus, such as copiers and printers and a production process thereof capable to solve the aforementioned problem.

An object of one aspect of the invention can be to suppress the exposure of the colorant, wax and the like to the toner particle surface, preventing the electric charge of the toner from being varied by the environmental changes or the like and formed images from suffering from density variations or fogging, and ensuring an appropriate fine dispersion of the wax in the toner and improvement in fixing performance of the toner, resulting in accomplishing a constant formation of favorable images.

A first electrostatic charge image developing toner according to the present invention comprises core particles formed by flocculating and fusion-bonding at least resin particles of polyester resin containing wax and colorant particles, and a coating layer comprising resin formed on the surface of the core particles.

The aforementioned first electrostatic charge image developing toner may be produced by the steps of: forming the core particles by flocculating and fusion-bonding at least the polyester resin particles containing wax and colorant particles dispersed in fluid dispersion; and forming the coating layer by adding a dispersion of resin particles for coating to a dispersion of core particles thereby flocculating and fusion-bonding the resin particles for coating to the surface of the core particles.

According to the above mentioned production process for the first electrostatic charge image developing toner, a sharp particle size distribution can be achieved by flocculating and fusion-bonding at least the polyester resin particles containing wax and the colorant particles for forming core particles.

Further, as the above first electrostatic image developing toner, the use of the resin particles of which core particles contain the wax makes it possible that the wax is dispersed finely and appropriately within the toner without flocculation, resulting in ensuring the toner with improved fixing performance and a consistent formation of favorable images. Furthermore, as the first electrostatic charge image developing toner, using the polyester resin for the aforesaid resin particles makes it possible that softening temperature of the toner is lowered and the wax is liquated promptly in fixing thereby obtaining the toner with low-temperature fixing performance and excellent transparency to light.

In addition, in the first electrostatic charge image developing toner, the coating layer comprised of the resin is affective to suppress the exposure of the colorant, wax and the like to the toner particle surface, preventing the electric charge of the toner from being varied by the environmental changes or the like and formed images from suffering from density variations or fogging.

Further, in the first electrostatic charge image developing toner, the coating layer may be comprised of a resin having a grass transition point Tg of more than 55° C. in order to prevent the toners from being flocculated enhancing a preservability under high temperature.

A second electrostatic charge image developing toner according to the present invention comprises core particles formed by flocculating and fusion-bonding at least resin particles containing wax and colorant particles, and a middle coating layer (a coating layer but for an outermost coating layer) and an outermost coating layer as the coating layer for coating the core particles formed by flocculating and fusion-bonding the resin particles. It is noted here that the wax is added to the resin particles used for forming the core particles and/or the middle coating layer.

The second electrostatic charge image developing toner production process according to the invention comprises steps of:

forming core particles by flocculating and fusion-bonding at least resin particles and colorant particles dispersed in a fluid dispersion;

adding a dispersion including resin particles for the middle coating layer to the dispersion wherein the core particles are dispersed, and forming the middle coating layer by flocculating and fusion-bonding the resin particles for the middle coating layer to the surface of the core particles; and adding a dispersion of resin particles for outermost coating layer to the dispersion wherein the core particles are dispersed and the middle coating layer are formed on the surface thereof, and forming the outermost coating layer by flocculating and fusion-bonding the resin particles for the outermost coating layer to surface of the middle coating layer. It is noted here that the wax is added to the resin particles used for the core particles and/or the middle coating layer.

According to the above mentioned production process for the second electrostatic charge image developing toner, a sharp particle size distribution can be achieved by flocculating and fusion-bonding at least the polyester resin particles containing wax and the colorant particles to form core particles.

Further, as the production process for the second electrostatic image developing toner, using the resin particles containing wax for core particles and/or the resin particles containing wax for the middle coating layer makes it possible that the wax is dispersed finely and appropriately within the toner without flocculation thereby fixing performance of the toner is improved and a consistent formation of favorable images is ensured. Furthermore, the use of the polyester resin for the aforesaid resin particles makes it possible that the softening temperature of the toner is lowered and the wax is liquated promptly in fixing thereby obtaining the toner with low-temperature fixing performance and excellent transparency to light.

In the second electrostatic charge image developing toner, by not using the resin particles containing wax as the resin particles for forming the outermost coating layer, the exposure of the colorant, wax and the like to the toner particle surface is suppressed, the electric charge of the toner is prevented from being varied by the environmental changes or the like and the formed images are prevented from suffering from density variations or fogging. Furthermore, the use of a resin having the glass transition point tg of more than 55° C. as the resin particles constituting the outermost coating layer makes it possible to prevent the toner from being aggregated each other enhancing the preservability under high temperature.

These and other objects, advantages and features of the invention will become apparent from the following description thereof.

DESCRIPTION OF THE PREFERRED EMBODIMENTS

An electrostatic charge image developing toner according to a preferred embodiment of the invention and a production process for the same will be described as below.

As described above, a first electrostatic charge image developing toner according to the embodiment of the invention comprises core particles formed by flocculating and fusion-bonding at least resin particles containing wax and colorant particles, and a coating layer comprising resin formed on the surface of the core particles.

As described above, a second electrostatic charge image developing toner according to the embodiment of the invention comprises: core particles formed by flocculating and fusion-bonding at least resin particles containing wax and colorant particles; and a middle coating layer and an outermost coating layer as the coating layer for coating the core particles formed by flocculating and fusion bonding resin particles. The resin particles for forming the core particles and/or the middle coating layer contain wax.

Examples of a usable resin as a constituent of the resin particles used for forming the above core particles or the coating layer include: radical polymerizable resins such as (meth)acrylate resins and aromatic vinyl resins; condensation polymerizable resins such as polyester resins; and the like. In general, there may be used the resin particles having a volume average particle size D4 of 80 to 200 nm. In the light of proper control of the adherence speed of the resin particles being flocculated or the thickness of the coating layers formed of the resin particles, it is desirable to use the resin particles having a volume average particle size of 100 to 150 nm. The first electrostatic charge image developing toner as described above uses the polyester resin as the resin particles for forming the core particles.

The above resin particles may be produced by a wet process such as an emulsion polymerization process, a suspension polymerization process and an emulsion dispersion process. It is preferred to produce the resin particles by the emulsion polymerization process facilitating the adjustment of the particle size.

The above resin particles may be produced by the emulsion polymerization process in the following manner, for example. Droplets of a radical polymerizable monomer solution are formed in a water-based medium containing a surfactant and a radical polymerization initiator. The radical polymerizable monomer in the form of droplets are emulsified and polymerized by the polymerization initiator.

The aforesaid radical polymerizable monomer used for forming the resin particles include, for example, aromatic vinyl monomers, (meth)acrylate monomers and the like. From the standpoint of increasing the dispersibility/stability of the resin particles, in particular, a radical polymerizable monomer having an acidic group may preferably be used.

Examples of the aforesaid aromatic vinyl monomer include styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene; and the derivatives thereof.

Examples of the aforesaid (meth)acrylate monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl â-hydroxyacrylate, propyl ã-aminoacrylate, stearyl methacrylate, dimethylaminoethyl methacrylate, diethylaminoethyl methacrylate and the like.

Examples of the aforesaid radical polymerizable monomer having an acidic group include monomers containing a carboxylic group such as acrylic acid, methacrylic acid, fumaric acid, maleic acid, itaconic acid, cinnamic acid, monobutyl maleate and monooctyl maleate; monomers containing a sulfonic group such as styrene sulfonate, allylsulfosuccinate and octyl allylsulfosuccinate; and the like. The all or a part of the radical polymerizable monomer having the acidic group may have a structure of an alkali metal salt such as sodium or potassium or of an alkaline earth metal salt such as calcium.

Where the radical polymerizable monomer and the radical polymerizable monomer having the acidic group are used in combination, the resin microparticles are not sufficiently increased in the dispersibility/stability if the proportion of the radical polymerizable monomer having the acidic group is too small. If, on the other hand, the radical polymerizable monomer having the acidic group is used in an excessive proportion, hygroscopicity associated with the acidic group poses a problem. On this account, the proportion of the radical polymerizable monomer having the acidic group is limited to the range of 0.1 to 20 mass % or preferably of 0.1 to 15 mass %.

For improving the anti-stress performance of the resultant toner, a radically polymerizable crosslinking agent may be added for copolymerization with the aforesaid radical polymerizable monomer.

Examples of the aforesaid radically polymerizable crosslinking agent include compounds having two or more unsaturated bonds, such as divinylbenzene, divinylnaphthalene, divinylether, diethylene glycol methacrylate, ethylene glycol dimethacrylate, polyethylene glycol dimethacrylate, and diallylphthalate.

A chain transfer agent commonly used in the art may be used for adjusting the molecular weight of the above resin. A usable chain transfer agent is not particularly limited herein and may include, for example, mercaptans such as octyl mercaptan, dodecyl mercaptan and tert-dodecyl mercaptan; and styrene dimmers.

The aforesaid radical polymerization initiator used for polymerizing the above radical polymerizable monomers may be soluble in water. Examples of a usable radical polymerization initiator include: persulfates such as potassium persulfate and ammonium persulfate; azo compounds such as 4,4'-azobis(4-cyanovaleric acid) and its salt and a salt of 2,2'-azobis(2-amidinopropane); peroxide compounds; and the like.

The aforesaid radical polymerization initiator may be used in combination with a reducing agent, as required, so as to be used as a redox initiator. The use of the redox initiator is effective to increase polymerization activity so that the polymerization temperature may be lowered. In addition, the polymerization time may be reduced.

A surfactant may be used as an emulsifier for emulsion polymerizing the aforesaid radical polymerizable monomers. Ionic surfactants and nonionic surfactants may be used as such a surfactant.

Examples of a usable ionic surfactant include: sulfonates such as sodium dodecylbenzenesulfonate, sodium arylalkylpolyethersulfonate, sodium 3,3-disulfonediphenylurea-4,4-diazo-bis-amino-8-naphtho 1-6-sulfonate, ortho-carboxybenzene-azo-dimethylaniline, and sodium 2,2,5,5-tetramethyl-triphenylmethane-4,4-diazo-bis-â-naphtol-6-sulfonate; sulfate salts such as sodium dodecylsulfate, sodium tetradecylsulfate, sodium pentadecylsulfate, and sodium octylsulfate; fatty acid salts such as sodium oleate, sodium laurate, sodium caprate, sodium caprylate, sodium caproate, potassium stearate, and calcium oleate; and the like.

Examples of a usable nonionic surfactant include: polyethylene oxide, polypropylene oxide, a combination of polypropylene oxide and polyethylene oxide, an ester of polyethylene glycol and higher fatty acid, alkylphenolpolyethylene oxide, an ester of higher fatty acid and polyethylene glycol, an ester of higher fatty acid and polypropylene oxide, sorbitan ester and the like. The nonionic surfactant may be used in combination with the above ionic surfactant.

In the aforementioned case where the aforesaid nonionic surfactant is used as the emulsifier in the emulsion polymerization process in which the resin particles and the colorant particles are flocculated together or the resin particles are flocculated to the surface of the core particles, the nonionic surfactant may also be used for adjusting the cohesive force of the dispersed particles. Specifically, the nonionic surfactant is significantly lowered in the power of dispersing/stabilizing the particles at temperatures higher than its cloud point. Hence, a suitable amount of nonionic surfactant may be previously added in the preparation of the dispersion of resin particles or of the colorant particles. When the particles are flocculated, the inter-particle cohesive force may be adjusted by controlling the temperature of the dispersion to a suitable level above the aforesaid cloud point of the nonionic surfactant.

As the aforesaid resin particles containing wax for forming the core particles and the middle coating layer, any kind of resin may be used, especially the polyester resin is preferably used to obtain a toner with improved fixing performance and excellent transparency to light. In the use of the resin particles containing wax for forming the core particles, it is preferred that content of the resin particles containing wax based on the core particles is in a range of 5 to 99 wt %. In the use of the resin particles containing wax for forming the middle coating layer, it is preferred that content of the resin particles containing wax based on the core particles is in the range of 5 to 30 wt %. The use of the resin particles containing wax limited the above range gives a toner showing a good thermostability and excellent fixing performance.

The aforesaid polyester resin used for the resin particles containing wax may have a number average molecular weight (Mn) in the range of 2000 to 10000, or preferably of 3000 to 8000, and a value of weight average molecular weight (Mw)/number average molecular weight (Mn) in the range of 2 to 10, or preferably of 3 to 7. The above limited number and range are determined by the following reasons. If the number average molecular weight of the polyester resin is less than 2000, the toner is degraded in stability in storage. On the other hand, if the number average molecular weight of the polyester resin is more than 10000, the toner is decreased in transparency to light. Further, if the above value of Mw/Mn of the polyester resin is less than 2, it becomes difficult to produce the toner. On the other hand, if the above value of Mw/Mn of the polyester resin is more than 10, the toner is decreased in transparency to light.

As the aforesaid polyester resin, the polyester resin having an acid value of 2 to 30 mgKOH/g, or preferably of 5 to 25 mgKOH/g may be used. The above limited value is determined by the following reasons. If the acid value is less than 2 mgKOH/g, dispersibility of the wax is degraded. On the other hand, if the acid value is more than 30 mgKOH/g, the toner is decreased in electric charge stability by effect of humidity.

The polyester resin can be prepared by a reaction of an alcohol component and an acid component, which is a process generally taken. As the aforesaid alcohol component, etherized diphenols is preferably used. As the aforesaid acid component, aromatic dicarboxylic acids is preferably used.

Examples of the aforesaid etherized diphenols include polyoxypropylene(2,2)-2,2-bis(4-hydroxyphenyl)propane, polyoxypropylene(3,3)-2,2-bis(4-hydroxyphenyl)propane, polyoxypropylene(2,0)-2,2-bis(4-hydroxyphenyl)propane, polyoxypropylene(6)-2,2-bis(4-hydroxyphenyl)propane, polyoxyethylene(2) -2, 2-bis (4-hydroxyphenyl) and the like.

In addition to the etherized diphenols recited above, examples of the alcohol component include: diols such as ethylene glycol, diethylene glycol, triethylene glycol, 1,2-propylene glycol, 1,3-propylene glycol, 1,4-butanediol and neopentyl glycol; and sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and the like.

Examples of the aforesaid aromatic dicarboxylic acids include aromatic dicarboxylic acid such as terephthalic acid and isophthalic acid and anhydrides thereof or lower alkyl esters thereof.

In addition to the aromatic dicarboxylic acids recited above, examples of the aforesaid acid component include fumaric acid, maleic acid, succinic acid, aliphatic dicarboxylic acid such as alkyl having a number of carbon of 4 to 18 or alkenyl succinic acid and anhydrides thereof or lower alkyl esters thereof.

From the standpoint of adjusting the acid value of the polyester resin and enhancing strength thereof, for example, 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid and anhydrides thereof or lower alkyl esters thereof can be added to the polyester resin. However, the additive amount of the above may preferably be limited to be small so as not to damage the toner in the transparency to the light and so on.

Further, as the aforesaid polyester resin, urethane denatured polyester resin obtained by a reaction of polyester resin and isocyanate, acryl denatured polyester resin and the like can be used.

In order to form the resin particles containing resin and wax, a resin solution containing wax is adjusted by adding the resin and the wax to a non water-soluble organic solvent. The resin solution containing wax is emulsified and dispersed in the water-based medium for forming O/W type emulsion. Then, the non water-soluble organic solvent is removed from the O/W type emulsion.

As the non water-soluble organic solvent, for example, toluene, benzene, xylen, methylene chloride, chloroform, carbon tetrachloride, dimethyl ether, diethyl ether, methyl acetate, ethyl acetate, butyl acetate, methyl propionate, ethyl propionate, butyl propionate, dimethyl oxalate, diethyl oxalate, dimethyl succinate, diethyl succinate, diethylene glycol dimethyl ether, diethylene glycol diethyl ether, diethylene glycol dibutyl ether, ethylene glycol monoacetate, diethylene glycol monoacetate, ethanol, propanol, butanol, diaceton alcohol, aceton, methyl ethyl ketone, methyl isobutyl ketone, N,N-dimethyl formamide, 2-methoxyethanol, 2-ethoxyethanol, diethylene glycol monomethyl ether, diethylene glycol monoethyl ether, diethylene glycol monombuthyl ether, dipropylene glycol monomethyl ether, dipropylene glycol monoethyl ether, 2-methoxyethyl acetate, 2-ethoxyethyl acetate and the like may be used alone or in combination of plural types.

The aforesaid wax may be any of the known waxes commonly used in the toner. Examples of a usable wax include: polyolefin waxes such as polyethylene wax and polypropylene wax; naturally occurring waxes such as carnauba wax and rice wax; montan wax; Fischer-Tropsh wax; paraffin waxes; and the like. When the polyester resin is used as the above resin, it is preferred to use an oxidized wax from the standpoint of improving the dispersibility of the particles.

In adjustment of the above resin solution containing wax and dissolution or dispersion of the resin and wax in the non water-soluble organic solvent, a ball mill, a sand mill, a homomixer, an ultrasonic homogenizer and the like may be utilized.

An appropriate dispersion stabilizer is preferably added to the water-based medium for forming O/W emulsion by emulsifying and dispersing the resin solution containing wax within the water-based medium. Examples of such a dispersion stabilizer include polyvinyl alcohol, gelatin, gum Arabic, methyl cellulose, ethyl cellulose, methyl hydroxypropyl cellulose, carboxymethyl cellulose sodium salt, sodium dodecylbenzenesulfate, sodium dodecylbenzenesulfonate, octyl sodium sulfate, sodium laurate, calcium phosphate, magnesium phosphate, aluminum phosphate, calcium carbonate, magnesium carbonate, barium chloride, bentonite and the like. Generally, such a dispersion stabilizer recited above is added to the water-based medium in the range of 0.05 to 3 wt %.

The resin solution containing wax is stirred well in the water-based medium by means of a stirrer such as the homomixer for forming the O/W type emulsion as described above.

In removing the organic solvent recited above from the O/W type emulsion, the O/W type emulsion is stirred being heated to remove the organic solvent thereby forming resin particles containing wax having a particle size of 0.1 to 1 μm.

The aforesaid colorant particles for forming the core particles may be prepared by dispersing a colorant in a water-based medium.

The known pigments commonly used in the art may be used as the colorant. Examples of a usable pigment include carbon black, aniline blue, chalcoyl blue, chrome yellow, ultramarine blue, Du Pont Oil Red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. solvent yellow 162, C.I. pigment yellow 180, C.I. pigment yellow 185, C.I. pigment blue 15:1, C.I. pigment blue 15:3 and the like.

Where the colorant particles are prepared by dispersing the above colorant in the water-based medium, any of the above colorants is added to the water-based medium while the concentration of the surfactant is adjusted to above a critical micelle concentration. A disperser is used for dispersing the above colorant in the water-based medium. The surfactant used here may be the same as that used for preparing the aforesaid resin particles. A usable disperser include, for example, pressure dispersers such as ultrasonic dispersers, mechanical homogenizers and pressure-type homogenizers; medium-type dispersers such as sand grinders, diamond fine mills; and the like.

According to the electrostatic charge image developing toners of the embodiments of the present invention, the resin particles, the resin particles containing wax and colorant particles are flocculated in the fluid dispersion and fusion-bonded by heating to form the core particles.

Where the above resin particles, resin particles containing wax and colorant particles are flocculated in the fluid dispersion, a salting agent as a flocculating agent is added in an amount to provide a concentration higher than the critical flocculation concentration.

As the above salting agent, inorganic metal salts such as alkali metal salts and alkaline earth metal salts may be used. Examples of a usable alkali metal include monovalent metals such as lithium, potassium and sodium. Examples of a usable alkaline earth metal include divalent metals such as magnesium, calcium, strontium and barium; and metals having a valence of more than 2, such as aluminum. In general, potassium, sodium, magnesium, calcium, barium and the like may be used. Salts of these metals include chlorine salt, bromine salt, iodine salt, carbonate, sulfate and the like.

In the preparation of the above core particles, a charge control agent and magnetic powder and the like may be admixed to the aforementioned resin particles, resin particles containing wax and colorant particles.

As the charge control agent, any of the known charge control agents used in the prior-art electrostatic charge image developing toner for controlling the chargeability thereof may be used. Examples of a usable charge control agent include: metal-containing dyes such as fluorinated surfactants, metal complexes of salicylic acid and azo metal compounds; polymeric acid comprising a copolymer containing maleic acid as a monomer component; azine dyes such as quaternary ammonium salt and nigrosine; carbon black; and the like. In order to attain a favorable electric charge, the charge control agent may be used in an amount of 0.01 to 5 parts by weight or preferably of 0.05 to 3 parts by weight based on the overall weight of the resin including the coating layer.

The core particles formed in the aforementioned manner may be coated with a coating layer comprising resin. That is, a dispersion of resin particles is added to a dispersion of the above core particles so that the resin particles are flocculated and fusion-bonded to the core particles thereby to form the coating layer thereover.

The resin particles for forming the coating layer can be the same or different one of the aforesaid core particles. As the same as forming process of the core particles, the resin particles wherein the wax is contained at least one part thereof can be used for forming the middle coating layer.

Where the dispersion of the resin particles is added to the dispersion of the core particles thereby to flocculate the resin particles to the surface of the core particles, as described above, the same procedure as the formation of the core particles is taken. That is, a salting agent as the flocculating agent is added in an amount to provide a concentration higher than the critical flocculation concentration so as to flocculate the resin particles to the surface of the core particles.

The salting agent may be the same as that used for forming the core particles. Alternatively, a salting agent which has a higher valence and a greater cohesive force than that used for forming the core particles may be used so as to further increase the speed of flocculating the resin particles to the surface of the core particles. As the salting agent of a higher valence, there may be used, for example, a trivalent aluminum salt, tetravalent aluminum polychloride or the like.

As described above, the resin-coating layer is formed on the surface of the core particles, thus the dispersion of toner is obtained. The toner is filtered off from the dispersion. Then, the toner as filtered is washed to remove the surfactant, the salting agent and the like and then dried. The toner is dried as described above on condition that moisture content of the dry treated toner is less than 5 wt %, preferably, less than 2 wt %.

In the case where the toner as dry treated is flocculated each other by weak attraction force among particles, the toner is crush treated. The toner may preferably have a volume average particle size (D4) of 3 to 8 μm.

The toner of the aforementioned embodiment may be admixed with an external additive. As such an external additive, any of the known inorganic particles used for adjusting toner fluidity may be used.

Examples of such an inorganic particles include: a variety of carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, diamond carbon lactam; a variety of nitrides such as boron nitride, titanium nitride and zirconium nitride; a variety of borides such as zirconium boride; a variety of oxides such as titanium oxide, calcium oxide, magnesium oxide, zinc oxide, copper oxide, aluminum oxide, silica and colloidal silica; a variety of titanate compounds such as calcium titanate, magnesium titanate and strontium titanate; sulfides such as molybdenum disulfide; a variety of fluorides such as magnesium fluoride and carbon fluoride; a variety of metal soaps such as aluminum stearate, calcium stearate, zinc stearate and magnesium stearate; and a variety of non-magnetic inorganic particles such as talc and bentonite. These particles may be used alone or in combination of plural types.

It is preferred from the standpoint of controlling the adhesion of the external additive that the aforementioned microparticles of silica, titanium oxide, alumina, zinc oxide or the like may be surface treated with a hydrophobic treating agent conventionally used in the art, such as silane coupling agent, titanate coupling agent, silicone oil or silicone varnish; fluorinated silane coupling agent or fluorinated silicone oil; a coupling agent having an amino group or a quaternary ammonium salt; modified silicone oil; or the like.

The aforesaid inorganic particles may have an average primary particle size of 5 to 100 nm, preferably of 10 to 50 nm, or more preferably of 20 to 40 nm. This is because the use of the inorganic particles having such a particle size provides for an effective control of the adhesion stress of the toner.

Assume that the amount of inorganic particles added to the toner is represented by G (wt %) and that the median size based on volume of the above toner particles is represented by D50 (ìm), the value of D50×G may be adjusted to the range of 4 to 14, preferably of 5 to 13.5 or more preferably of 6 to 13 such as to enhance the effect of the toner fluidity and the like.

Besides the aforementioned inorganic particles, organic particles may be externally added.

Such organic particles may be formed from styrene, (meth) acryl, benzoguanamine, melamine, tetrafluoroethylene, silicone, polyethylene, polypropylene or the like by a wet polymerization process such as emulsion polymerization process, soap-free emulsion polymerization process or non-aqueous dispersion polymerization process; a vapor phase process; or the like. The particles may be added as a cleaning aid or the like.

The electrostatic charge image developing toner according to the above embodiment may be used as a color toner of each color for use in full-color image forming apparatuses and also as a monochromatic toner for use in monochromatic image forming apparatuses.

The electrostatic charge image developing toner according to the embodiment provides an adequate transfer performance while retaining good chargeability and stability to environment. Where the toner of the embodiment is used as a color toner of each color in the full-color image forming apparatus, therefore, the formed images are prevented from suffering white spots.

The electrostatic charge image developing toner of the invention may be used in image forming apparatuses having any type of fixing device because the toner provides an adequate transfer performance while retaining the good chargeability and stability to environment, as described above. In an image forming apparatus employing a fixing device with a reduced amount of lubricant applied to a fixing member such as a roller or the fixing device with the mold release oil applied thereto in an amount of not more than 4 $mg/m^2$, or in an image forming apparatus employing a fixing device dispensing with the application of the mold release oil, for example, the toner may be used to form images effectively reduced in the white spots.

The electrostatic charge image developing toner of the invention may be used as a one-component developer free from carrier and also as a two-component developer comprising a combination of the toner and the carrier.

Next, specific description will be made on electrostatic charge image developing toners according to the examples of the invention and the production processes for the same. Furthermore, the superiority of the electrostatic charge image developing toners according to the examples of the invention will be demonstrated with reference to comparative examples.

For preparation of electrostatic charge image developing toners of Examples 1 to 8 and of Comparative Examples 1 and 2, the following procedures were taken to prepare dispersions of resin particles A1 to A3, dispersion of resin particles containing wax B1 and B2, dispersions of colorant particles C1 and C2, and dispersions of waxes D1 and D2.

(Preparation of Dispersion of Resin Particles A1)

450 parts by weight of distilled water and 0.56 parts by weight of sodium dodecylsulfate were charged to a reaction vessel equipped with a stirrer, a condenser and a temperature sensor. The mixture was heated with stirring to 80° C. under a nitrogen flow and then, was added with 120 parts by weight of aqueous solution of 1 wt % potassium persulfate.

Subsequently, a monomer solution mixture containing 117 parts by weight of styrene, 41 parts by weight of butyl acrylate, 14 parts by weight of methacrylic acid and 3 parts by weight of n-octylmercaptan was added dropwise over the course of 1.5 hours and maintained in this state for carrying out polymerization over 2 hours and then, was cooled to room temperatures in the above reaction vessel. Thus was obtained a dispersion of resin particles A1. The resultant resin particles A1 had a weight average molecular weight of 58000, a glass transition point Tg of 52° C., and a softening point Tm of 108° C. Furthermore, the resin particles had a volume average particle size of 150 nm as determined by Super-dynamic Light Scattering Spectrophotometer (ELS-800 commercially available from OTSUKA ELECTRONICS CO., LTD.).

The aforesaid weight average molecular weight was determined by gel permeation chromatography (807-IT model commercially available from NIHON BUNKO KOGYO-SYA) as follows. With column temperature maintained at 40° C., tetrahydrofuran as a carrier solvent was flowed through the column under a pressure of 1 $kg/cm^2$. A solution was prepared by dissolving 30 mg of measurement sample in 20 ml of tetrahydrofuran. Then, 0.5 mg of the resultant solution along with the carrier solvent were introduced into the above apparatus to determine the weight average molecular weight based on polystyrene standard.

The glass transition point Tg was determined by a differential scanning calorimeter (DSC-200 commercially available from Seiko Instruments Inc.) as follows. 10 mg of measurement sample was accurately weighed out and charged to an aluminum pan. On the other hand, alumina, as a reference, was charged to an aluminum pan. The sample at normal temperatures was heated to 200° C. at a rate of 30° C./min and then cooled. Measurement was taken in the temperature range of 20 to 120° C. while heating at a rate of 10° C./min. In an endothermic curve in a temperature range of 30 to 90° C. of the heating process, a shoulder of a main endothermic peak was determined as the glass transition point Tg.

The softening point Tm was determined by a flow tester (CFT-500 commercially available from SHIMADZU CORPORATION) as follows. 1.0 g of measurement sample was accurately weighed out and set in a die having a diameter of 1.0 mm and a length of 1.0 mm. The measurement was taken under the conditions: a rate of temperature rise at 30° C./min, a preheating time of 180 seconds, a load of 30 kg and a measurement temperature range of 60 to 180° C. A temperature at which a half of the above sample flowed out of the die was determined as the softening point Tm.

(Preparation of Dispersion of Resin Particles A2)

450 parts by weight of distilled water and 0.56 parts by weight of sodium dodecylsulfate were charged to a reaction vessel equipped with a stirrer, a condenser and a temperature sensor. The mixture was heated with stirring to 80° C. under a nitrogen flow and then, was added with 120 parts by weight of aqueous solution of 1 wt % potassium persulfate.

Subsequently, a monomer solution mixture containing 125 parts by weight of styrene, 40 parts by weight of butyl acrylate, 2.5 parts by weight of methacrylic acid and 3 parts by weight of n-octylmercaptan was added dropwise over the course of 1.5 hours and maintained in this state for carrying out polymerization over 2 hours and then, was cooled to room temperatures in the above reaction vessel. Thus was obtained a dispersion of resin particles A2. The resultant resin particles A2 had a weight average molecular weight of 62000, a glass transition point Tg of 65° C., and a softening point Tm of 130° C. Furthermore, the resin particles had a volume average particle size of 120 nm as determined by Super-dynamic Light Scattering Spectrophotometer (ELS-800 commercially available from OTSUKA ELECTRONICS CO., LTD.).

(Preparation of Dispersion of Resin Particles A3)

450 parts by weight of distilled water and 0.56 parts by weight of sodium dodecylsulfate were charged to a reaction vessel equipped with a stirrer, a condenser and a temperature sensor. The mixture was heated with stirring to 80° C. under a nitrogen flow and then, was added with 120 parts by weight of aqueous solution of 1 wt % potassium persulfate.

Subsequently, a monomer solution mixture containing 120 parts by weight of styrene, 38 parts by weight of butyl acrylate, 13 parts by weight of methacrylic acid, 3 parts by weight of n-octylmercaptan and 2 parts by weight of charge control agent (Sprion Black TRH commercially available from Hodogaya Chemical Co., Ltd.) was added dropwise over the course of 1.5 hours and maintained in this state for carrying out polymerization over 2 hours and then, was cooled to room temperatures in the reaction vessel. Thus was obtained a dispersion of resin particles A4. The resultant resin particles A4 had a weight average molecular weight of 48000, a glass transition point Tg of 55° C., and a softening point Tm of 110° C. Furthermore, the resin particles had a volume average particle size of 130 nm as determined by Super-dynamic Light Scattering Spectrophotometer (ELS-800 commercially available from OTSUKA ELECTRONICS CO., LTD.).

(Preparation of Dispersion of Resin Particles Containing Wax B1)

2200 parts by weight of polyoxyethylene(2,2)-2, 2-bis(4-hydroxyphenyl)propane, 120 parts by weight of neopentyl glycol, 1100 parts by weight of terephthalic acid and 200 parts by weight of isophthalic acid were charged to a 10 liter 4-necked glass flask equipped with a stirrer, a distillation column, inert gas inlet tube and a temperature sensor. The mixture was heated to 180° C. under a nitrogen flow and then, was added with 5 parts by weight of dibutyltin oxide and maintained in this state for 2 hours.

Subsequently, the mixture was heated to 230° C. and reacted until water is not distilled from the distillation column. Thus was obtained a polyester resin X. The polyester resin X had an acid value of 5.2 KOHmg/g, a softening point Tm of 122° C., a glass transition point Tg of 62° C., a number average molecular weight of 4500 and a weight average molecular weight/number average molecular weight of 3.6.

Next, 20 parts by weight of the polyester resin X, 8 parts by weight of carnauba wax (commercially available from CERARICA NODA Co., Ltd.), 70 parts by weight of ethyl acetate and 30 parts by weight of methyl ethyl ketone were charged to a beaker. The mixture was stirred by means of TK Homomixer (commercially available from Tokusyu Kika Kogyo Co., Ltd.) at 12000 rpm until the charged materials were dissolved or dispersed equally. Thus was prepared a resin solution containing wax.

Then, a water-based medium was prepared by dissolving 0.5 wt % of sodium dodecylbenzenesulfate and 0.5 wt % of polyvinyl alcohol as dispersion agents in 450 parts by weight of ion-exchanged water in 3-necked glass flask equipped with a temperature sensor and a stirrer.

Next, the water-based medium was added with the aforesaid resin solution containing wax. The mixture was stirred by means of TK Homomixer (commercially available from Tokusyu Kika Kogyo Co., Ltd.) at 10000 rpm for 30 minutes so that the resin solution containing wax was dispersed in the water-based medium in a suspension state. Thus was formed an O/W type emulsion.

Then, the O/W type emulsion was heated with stirring by means of TK Homomixer at 200 rpm in order to remove organic solvent from thereof. Thus was formed a dispersion of resin particles containing wax B1 having a volume average particles size of 180 nm.

(Preparation of Dispersion of Resin Particles Containing wax B2)

3700 parts by weight of polyoxyethylene(2,2)-2, 2-bis(4-hydroxyphenyl)propane, 200 parts by weight of polyoxyethylene(2,2)-2, 2-bis(4-hydroxyphenyl)propane, 1700 parts by weight of isophthalic acid and 30 parts by weight of terephthalic acid were charged to a 10 liter 4-necked glass flask equipped with a stirrer, a distillation column, inert gas inlet tube and a temperature sensor. Then, the same procedure of preparation for the aforesaid polyester resin X was taken to obtain a polyester resin Y having an acid value of 10.8 KOHmg/g, a softening point Tm of 103° C., a glass transition point of 68.4° C., a number average molecular weight of 4700 and a weight average molecular weight/number average molecular weight of 7.1.

Next, 20 parts by weight of the polyester resin Y, 8 parts by weight of carnauba wax (commercially available from CERARICA NODA Co., Ltd.), 70 parts by weight of ethyl acetate and 30 parts by weight of methyl ethyl ketone were charged to a beaker. The mixture was stirred by means of TK Homomixer (commercially available from Tokusyu Kika Kogyo Co., Ltd.) at 12000 rpm until the charged materials were dissolved or dispersed equally. Thus was prepared a resin solution containing wax.

Then, a water-based medium was prepared by dissolving 0.5 wt % of sodium dodecylbenzenesulfate and 0.5 wt % of polyvinyl alcohol as dispersion agents in 450 parts by weight of ion-exchanged water in a 3-necked glass flask equipped with the temperature sensor and the stirrer.

Next, the water-based medium was admixed with the aforesaid resin solution containing wax. The mixture was stirred by means of TK Homomixer (commercially available from Tokusyu Kika Kogyo Co., Ltd.) at 10000 rpm for 30 minutes so that the resin solution containing wax was dispersed in the water-based medium in a suspension state. Thus was formed an O/W type emulsion.

Then, the O/W type emulsion was heated with stirring by means of TK Homomixer at 200 rpm in order to remove organic solvent from thereof. Thus was formed a dispersion of resin particles containing wax B2 having a volume average particles size of 200 nm.

(Preparation of Dispersion of Colorant Particles C1)

10 parts by weight of sodium dodecylbenzenesulfonate (NEOGEN SC commercially available from DAIICHI-KOGYO CO., LTD.), as an anionic surfactant, was dissolved in 180 parts by weight of distilled water. Then, 25 parts by weight of carbon black (Legal 330R commercially available from Cabot Inc.), as a colorant, was dispersed in the resultant solution to form a dispersion of colorant particles C1. The dispersed colorant particles C1 had a volume average particle size of 106 nm as determined by Super-dynamic Light Scattering Spectrophotometer (ELS-800 commercially available from OTSUKA ELECTRONICS CO., LTD.).

(Preparation of Dispersion of Colorant Particles C2)

10 parts by weight of sodium dodecylbenzenesulfonate (NEOGEN SC commercially available from DAIICHI-KOGYO CO., LTD. ), as an anionic surfactant, was dissolved in 180 parts by weight of distilled water. Then, 25 parts by weight of cyan pigment (copper phthalocyanine B15:3 commercially available from Dainichiseika Color&Chemicals Mfg.Co., Ltd.), as a colorant, was dispersed in the resultant solution to form a dispersion of colorant particles C2. The dispersed colorant particles C2 had a volume average particle size of 110 nm as determined by Super-dynamic Light Scattering Spectrophotometer (ELS-800 commercially available from OTSUKA ELECTRONICS CO., LTD.).

(Preparation of Wax-D1 Dispersion)

A mixture containing 680 parts by weight of distilled water, 180 parts by weight of carnauba wax (commercially available from CERARICA NODA Co., Ltd.) and 17 parts by weight of sodium dodecylbenzenesulfonate (NEOGEN SC commercially available from DAIICHI-KOGYO CO., LTD.) was emulsified and dispersed by means of a high-pressure shearing machine. Thus was formed a dispersion of wax D1.

The particle size of the dispersed wax D1 was determined by means of Super-dynamic Light Scattering Spectrophotometer (ELS-800 commercially available from OTSUKA ELECTRONICS CO., LTD.). The wax D1 had a volume average particle size of 110 nm.

(Preparation of Wax-D2 Dispersion)

A mixture containing 680 parts by weight of distilled water, 180 parts by weight of wax of pentaerythritol ester (UNISTAR H476 commercially available from NOF CORPORATION) and 17 parts by weight of sodium dodecylbenzenesulfonate (NEOGEN SC commercially available from DAIICHI-KOGYO CO., LTD.) was emulsified and dispersed by means of the high-pressure shearing machine. Thus was formed a dispersion of wax D2. The particle size of the dispersed wax D2 was determined by means of Super-dynamic Light Scattering Spectrophotometer (ELS-800 commercially available from OTSUKA ELECTRONICS CO., LTD.). The wax D2 had a volume average particle size of 130 nm.

EXAMPLE 1

In Example 1, the following procedure was taken for forming core particles. 240 parts by weight of the dispersion of resin particles A1 having the glass transition point of 52° C., 60 parts by weight of the dispersion of resin particles containing wax B1, 24 parts by weight of the dispersion of colorant particles C1, 5 parts by weight of sodium dodecylbenzenesulfate as an anionic surfactant (NEOGEN SC commercially available from DAIICHI-KOGYO CO., LTD.) and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 80° C. and retained in this state for 0.5 hour. Then, the dispersion mixture was heated to 88° C. and retained in this state for 0.5 hour so as to form a dispersion of core particles. The volume average particle size of the core particles was determined using Coulter multi-sizer II (commercially available from Coulter Electronics Ltd.) and an aperture tube of 50 μm. The core particles had a volume average particle size of 4.3 μm.

Subsequently, the above core-particle dispersion was cooled to 75° C. and was admixed with 48 parts by weight of the dispersion of resin particles A2 having the glass transition point of 65° C. The dispersion mixture was heated to 83° C. and retained in this state for 1.5 hours and then, 120 parts by weight of aqueous solution of 20 wt % sodium chloride was added. The resultant mixture was heated to 92° C. and retained in this state for 1 hour to fusion-bond resin particles A2 to the surface of the core particle thereby forming a coating layer. Thus was obtained toner particles.

The dispersion was cooled to room temperatures and then, the toner particles were filtered off. The toner particles were washed with distilled water and filtered several times and then dried. The toner particles had a volume average particle size of 4.4 μm.

Then, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having a volume average particle size of 0.2 ìm, by means of a Henschel mixer which was operated for 60 seconds at a circumferential speed of 40 m/sec. Thereafter, the resultant mixture was filtered through a 90 ìm filter to give an electrostatic charging image developing toner of Example 1.

The average roundness in the electrostatic charging image developing toner of Example 1 was determined as follows. Measurement was taken by means of a flow particle image analyzer (EPIA-2000 commercially available from SYSMEX CORPORATION) and the average roundness calculated based on the following equation was 0.962. Average Roundness=Circumferential length of a circle having an equal area to that of particle projection image/Circumferential length of particle projection image.

EXAMPLE 2

Example 2 used the dispersion of resin particles containing wax B2 for forming core particles in place of the dispersion of resin particles containing wax B1 which was used in Example 1. Otherwise, the same procedure as in Example 1 was taken to form core particles. Further, the same procedure as in Example 1 was taken to obtain toner particles. That is, the resin particles A2 were fusion-bonded to the surface of the core particles thereby forming a coating layer. The toner particles thus formed had a volume average particle size of 4.8 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Example 2. The average roundness of the electrostatic charge image developing toner of Example 2 was 0.961.

EXAMPLE 3

Example 3 used the dispersion solution of resin particles A3 having a glass transition point Tg of 55° C. for forming core particles in place of the dispersion of resin particles A1 having a glass transition point of 52° C. which was used in Example 1. Otherwise, the same procedure as in Example 1 was taken to form core particles. Furthermore, the same procedure as in Example 1 was taken to obtain toner particles. That is, the resin particles A2 were fusion-bonded to the surface of the core particles thereby forming a coating layer. The toner particles thus obtained had a volume average particle size of 4.7 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Example 3. The average roundness of the electrostatic charge image developing toner of Example 3 was 0.959.

EXAMPLE 4

Example 4 used the dispersion of colorant particles C2 for forming core particles in place of the dispersion of colorant particles C1 which was used in Example 1. Otherwise, the same procedure as in Example 1 was taken to form core particles. Furthermore, the same procedure as in Example 1 was taken to obtain toner particles. That is, the resin particles A2 were fusion-bonded to the surface of the core particles thereby forming a coating layer. The toner particles thus formed had a volume average particle size of 4.6 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Example 4. The average roundness of the electrostatic charge image developing toner of Example 4 was 0.961.

EXAMPLE 5

In Example 5, for forming core particles, 240 parts by weight of the dispersion of resin particles A1 having the glass transition point of 52° C., 24 parts by weight of the dispersion of colorant particles C1, 5 parts by weight of sodium dodecylbenzenesulfonate (NEOGEN SC commercially available from DAIICHI-KOGYO CO., LTD.), as an anionic surfactant and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 80° C. and retained in this state for 1.5 hours so as to form a dispersion of core particles. The core particles had a volume average particle size of 4.2 μm.

After cooled to 75° C., the above core-particle dispersion was admixed with 48 parts by weight of the dispersion of resin particles A1 which was the same one as the core particles, 60 parts by weight of resin particles containing wax B1 and 20 parts by weight of aqueous solution of 50 wt % magnesium chloride. The resultant dispersion mixture was heated to 83° C. and retained in this state for 0.5 hour for fusion-bonding the resin particles A1 and the resin particles containing wax B1 to the surface of the core particles. Thus was formed a first coating layer (middle coating layer).

After cooled to 75° C., the above dispersion was admixed with 38 parts by weight of the dispersion of resin particles A2 having a glass transition point of 65° C. and heated to 83° C. and retained in this state for 0.5 hour. Then, the dispersion was admixed with 120 parts by weight of aqueous solution of 20 wt % sodium chloride, heated to 92° C. and retained for 1 hour so as to fusion-bond the resin particles A2 for forming a second coating layer (outermost coating layer) over the first coating layer overlaid on the core particles. Thus was obtained a dispersion of toner particles.

The resultant dispersion was cooled to room temperatures and then, the toner particles were filtered off. The toner particles were washed with distilled water and filtered several times and then dried. Thus was obtained toner particles having a volume average particle size of 4.5 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Example 5. The average roundness of the electrostatic charge image developing toner of Example 5 was 0.960.

EXAMPLE 6

Example 6 used the dispersion of resin particles A3 having the glass transition point Tg of 55° C. in place of the dispersion of resin particles A1 having the glass transition point Tg of 52° C., which was used in Example 5. Otherwise, the same procedure as in Example 5 was taken to form core particles. Furthermore, the same procedure as in Example 5 was taken to obtain toner particles. That is, the resin particles A1 and the resin particles containing wax B1 were fusion-bonded to the surface of core particles to form a first coating layer (middle coating layer) and then, the resin particles A2 were fusion-bonded so as to form a second coating layer (outermost coating layer) over the first coating layer. The toner particles had a volume average particle size of 4.9 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Example 6. The average roundness of the electrostatic charge image developing toner of Example 6 was 0.961

EXAMPLE 7

In Example 7, for forming core particles, 240 parts by weight of the dispersion of resin particles A1 having the glass transition point of 52° C., 30 parts by weight of the dispersion of resin particle containing wax B1, 24 parts by weight of the dispersion of colorant particles C1, 5 parts by weight of sodium dodecylbenzenesulfonate (NEOGEN SC commercially available from DAIICHI-KOGYO CO., LTD.), as an anionic surfactant and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 80° C. and retained in this state for 1.5 hours so as to form a dispersion of core particles. The core particles had a volume average particle size of 4.4 μm.

After cooled to 75° C., the above core-particle dispersion was admixed with 48 parts by weight of the dispersion of resin A1 which was the same one as the core particles, 30 parts by weight of the dispersion of resin particles containing wax B2 and 20 parts by weight of aqueous solution of 50 wt % magnesium chloride. The resultant dispersion mixture was heated to 83° C. and retained in this state for 0.5 hour for fusion-bonding the resin particles A1 and the resin particles containing wax B2 to the surface of the core particles. Thus was formed a first coating layer (middle coating layer).

Subsequently, after cooled to 75° C., the above dispersion was admixed with 38 parts by weight of the dispersion of resin particles A2 having the glass transition point Tg of 65° C. and heated to 83° C. and retained in this state for 0.5 hour. Then, the dispersion mixture was further admixed with 120 parts by weight of aqueous solution of 50 wt % magnesium chloride and heated to 92° C. The dispersion mixture was retained in this state for 1 hour so as to fusion-bond the resin particles A2 for forming a second coating layer (outermost coating layer) over the first coating layer overlaid on the core particles. Thus was obtained a dispersion of toner particles.

The resultant dispersion was cooled to room temperatures and then, the toner particles were filtered off. The toner particles were washed with distilled water and filtered several times and then dried. Thus was obtained toner particles having a volume average particle size of 4.5 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Example 7. The average roundness of the electrostatic charge image developing toner of Example 7 was 0.963.

EXAMPLE 8

Example 8 used the dispersion of resin particles A3 having the glass transition point Tg of 55° C. in place of the dispersion of resin particles A1 having the glass transition point Tg of 52° C., which was used in Example 7. Otherwise, the same procedure as in Example 7 was taken to form core particles. Furthermore, the same procedure as in Example 7 was taken to obtain toner particles. That is, the resin particles A1 and the resin particles containing wax B2 were fusion-bonded to the surface of the core particles to form a first coating layer (middle coating layer) and then, the resin particles A2 were fusion-bonded so as to form a second coating layer (outermost coating layer) over the first coating layer. The toner particles had a volume average particle size of 4.8 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Example 8. The average roundness of the electrostatic charge image developing toner of Example 8 was 0.961

COMPARATIVE EXAMPLE 1

In Comparative Example 1, for forming core particles, 288 parts by weight of the dispersion of resin particles A1 having the glass transition point of 52° C., 13.6 parts by weight of the dispersion of wax D1, 24 parts by weight of the dispersion of colorant particles C1, 5 parts by weight of sodium dodecylbenzenesulfonate (NEOGEN SC commercially available from DAIICHI-KOGYO CO., LTD.), as an anionic surfactant and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated to 70° C. with stirring and retained in this state for 1.5 hours so as to form a dispersion of core particles. The core particles had a volume average particle size of 4.5 μm.

After cooled to 75° C., the above core-particle dispersion was admixed with 48 parts by weight of the dispersion of resin particles A2 having the glass transition point Tg of 65° C. The dispersion mixture was heated to 83° C. and retained in this state for 1.5 hours. Subsequently, the dispersion mixture was further admixed with 120 parts by weight of aqueous solution of 20 wt % sodium chloride and heated to 92° C. The dispersion mixture was retained in this state for 1 hour so as to fusion-bond the resin particles A2 for forming a coating layer on the surface of the core particles. Thus was obtained a dispersion of toner particles.

The resultant dispersion was cooled to room temperatures and then, the toner particles were filtered off. The toner particles were washed with distilled water and filtered several times and then dried. Thus was obtained toner particles having a volume average particle size of 4.7 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Comparative Example 1. The average roundness of the electrostatic charge image developing toner of Comparative Example 1 was 0.959.

COMPARATIVE EXAMPLE 2

In Comparative Example 2, for forming core particles, 240 parts by weight of the dispersion of resin particles A1 having the glass transition point of 52° C., 24 parts by weight of the dispersion of colorant particles C1, 5 parts by weight of sodium dodecylbenzenesulfonate (NEOGEN SC commercially available from DAIICHI-KOGYO CO., LTD.), as an anionic surfactant and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was further admixed with 40 parts by weight of aqueous solution of 50 wt % magnesium chloride. The dispersion mixture was heated with stirring to 80° C. and retained in this state for 1.5 hours so as to form a dispersion of core particles. The core particles had a volume average particle size of 4.3 μm.

After cooled to 75° C., the above core-particle dispersion was admixed with 48 parts by weight of the dispersion of resin particles A2 having the glass transition point Tg of 65° C. and 13.6 parts by weight of the dispersion of wax D2. The dispersion mixture was heated to 83° C. and retained in this state for 0.5 hour. Subsequently, the dispersion mixture was further admixed with 120 parts by weight of aqueous solution of 20 wt % sodium chloride and heated to 92° C. The dispersion mixture was retained in this state for 1 hour so as to fusion-bond the resin particles A2 for forming a coating layer on the surface of the core particles. Thus was obtained a dispersion of toner particles.

The resultant dispersion was cooled to room temperatures and then, the toner particles were filtered off. The toner particles were washed with distilled water and filtered several times and then dried. Thus was obtained toner particles having a volume average particle size of 4.5 μm.

Subsequently, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give an electrostatic charge image developing toner of Comparative Example 2. The average roundness of the electrostatic charge image developing toner of Comparative Example 2 was 0.961.

The electrostatic charge image developing toners of Examples 1 to 8 and of Comparative examples 1 and 2 produced in the aforementioned manners were evaluated for thermostability. The results are listed in Table 1 as below. The toners were examined as follows. A 10 g sample of each of the toners was allowed to stand under a high temperature of 50° C. for 24 hours and thereafter, visually observed. The thermostability of the individual toners was evaluated based on the following criteria: ○ represents a toner absolutely free from toner aggregation; Δ represents a toner containing less than 10 aggregated pieces; and represents a toner containing more than 10 aggregated pieces.

The above electrostatic charge image developing toners of Examples 1 to 8 and Comparative Examples 1 and 2 were also evaluated for anti-separation and anti-offset performances. The results are listed in Table 1 as below.

For examination of the anti-separation and anti-offset performances of each of electrostatic charge image developing toners, each of the electrostatic charge image developing toners was mixed with a carrier to form each developer having a toner density of 6 wt %. The following carrier was used. That is, 100 parts by weight of polyester resin (NE-1110 commercially available from Kao Corp.), 700 parts by weight of magnetic particles (Magnetite EPT-1000 commercially available from TODA KOGYO CORP.) and 2 parts by weight of carbon black (Mogal L commercially available from Cabot Inc.) were fully blended together by a Henschel mixer. The resultant mixture was melt kneaded by means of a twin-screw extruder/kneader having the temperature of its cylinder portion set to 180° C. and that of its cylinder head set to 170° C. After cooling, the kneaded product was roughly ground by a hammer mill and then finely pulverized by a jet pulverizer. The resultant particles were classified to give a binder-type carrier having a volume average particle size of 40 μm.

The anti-separation performance was examined as follows. Each of the above developers was used in a digital copier provided with an oil-less fixing device (DIALTA Di350 commercially available from Minolta Co., Ltd.). The copier was operated to fix to a recording paper sheet a 1.5 cm×1.5 cm solid image having a toner adhesion of 2.0 mg/cm$^2$. The fixing temperature was varied from 120° C. to 170° C. in steps of 2° C. The recording sheet was folded along the center of the image portion to evaluate the image separation by visual observation. The lowest fixing temperature was defined by a temperature intermediate a fixing temperature associated with a minor image separation and the lowest possible temperature to provide image fixation absolutely free from separation. The anti-separation performance was evaluated based on the criteria: ◎ represents a toner achieving a lowest fixing temperature of less than 142° C.; ○ represents a toner achieving a lowest fixing temperature of 142° C. or more and less than 146° C.; Δ represents a practically acceptable toner achieving a lowest fixing temperature of 146° C. or more and less than 152° C.; and represents a practically unacceptable toner having a lowest fixing temperature of 152° C. or more.

The anti-offset performance was examined as follows. Each of the above developers was used in the aforesaid digital copier (DIALTA Di350 commercially available from Minolta Co., Ltd.) for producing a copy of a halftone image. The speed of a fixing system of the copier was set to ½ of the normal speed whereas the fixing temperature was varied from 130° C. to 190° C. in steps of 2° C. The resultant copies were examined for offset by visual observation so as to determine a temperature associated with offset occurrence. The anti-offset performance was evaluated based on the criteria: ◎ represents a toner having an offset occurrence temperature of 168° C. or more; ○ represents a toner having an offset occurrence temperature of 160° C. or more and less than 168° C.; Δ represents a practically acceptable toner having an offset occurrence temperature of 155° C. or more and less than 160° C.; and X represents a practically unacceptable toner having an offset occurrence temperature of less than 155° C.

The above electrostatic charge image developing toners of Examples 1 to 8 and of Comparative Examples 1 and 2 were also examined for the stability to environment. The results are listed in Table 1 as below.

The stability to environment was examined as follows. A 30 g sample of each developer was allowed to stand under low-temperature, low-humidity environment (10° C., 15%) for 24 hours, whereas a 30 g sample of each developer was allowed to stand under high-temperature, high-humidity environment (30° C., 85%). Each developer sample was charged to a 50 cc polyethylene vessel and was agitated by a ball mill which was operated at 120 rpm for 5 minutes. Thereafter, the electric charge of each electrostatic charge image developing toner was determined by a blow-off method. There was determined a difference between the electric charges of the toners allowed to stand under the low-temperature, low-humidity environment and under the high-temperature, high-humidity environment. The stability to environment was evaluated based on the criteria: ◎ represents a toner having an absolute difference value of less than 6 μC/g; ○ represents a toner having an absolute difference value of 6 μC/g or more and less than 7 μC/g; Δ represents a toner having an absolute difference value of 7 μC/g or more and less than 8 μC/g; represents a toner having an absolute difference value of 8 μC/g or more and less than 9 μC/g; and X represents a toner having an absolute difference value of less than 9 μC/g.

The above electrostatic charge image developing toners of Examples 1 to 8 and of Comparative Examples 1 and 2 were also examined for the anti-stress performance. The results are listed in Table 1 as below. The anti-stress performance was examined as follows. Each of the above developers was used in the digital copier (DIALTA Di350 commercially available from Minolta Co., Ltd.) for continuously printing an image on 100,000 white sheets. Thereafter, the photosensitive member was examined for adhesion of thin film of toner microparticles to the surface thereof. The anti-stress performance was evaluated based on the criteria: ○ represents a toner producing no thin-film adhesion; and represents a toner producing thin-film adhesion.

TABLE 1

| | COMPONENT OF CORE PARTICLES | COMPONENT OF FIRST COATING LAYER | COMPONENT OF SECOND COATING LAYER | THERMO-STABIILTY | STABILITY TO ENVIRONMENT | ANTI-SEPARATION PERFORMANCE | ANTI-OFFSET PERFORMANCE | ANTI-STRESS PERFORMANCE |
|---|---|---|---|---|---|---|---|---|
| EXAMPLE 1 | A1, B1, C1 | A2 | — | ○ | ◎ | ◎ | ◎ | ○ |
| EXAMPLE 2 | A1, B2, C1 | A2 | — | ○ | ◎ | ◎ | ◎ | ○ |
| EXAMPLE 3 | A3, B1, C1 | A2 | — | ○ | ◎ | ◎ | ◎ | ○ |
| EXAMPLE 4 | A1, B1, C2 | A2 | — | ○ | ◎ | ◎ | ◎ | ○ |
| EXAMPLE 5 | A1, C1 | A1, B1 | A2 | ○ | ◎ | ◎ | ◎ | ○ |
| EXAMPLE 6 | A3, C1 | A1, B1 | A2 | ○ | ◎ | ◎ | ◎ | ○ |
| EXAMPLE 7 | A1, B1, C1 | A1, B2 | A2 | ○ | ◎ | ◎ | ◎ | ○ |
| EXAMPLE 8 | A3, B1, C1 | A1, B2 | A2 | ○ | ◎ | ◎ | ◎ | ○ |
| COMPARATIVE EXAMPLE 1 | A1, D1, C1 | A2 | — | Δ | XX | X | X | ○ |
| COMPARATIVE EXAMPLE 2 | A1, C1 | A2 | — | ○ | X | X | X | X |

As apparent from the results, all of the electrostatic charge image developing toners of Examples 1 to 8 using the resin particles wherein the wax is contained at least one part thereof for forming the core particles and the middle coating layer, have excellent thermostability, stability to environment, anti-separation performance, anti-offset performance and anti-stress performance. In contrast, the electrostatic charge image developing toners of Comparative Examples 1 and 2 using resin particles containing no wax have poor stability to environment, anti-separation performance and anti-offset performance.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An electrostatic charge image developing toner comprising core particles formed by flocculating and fusion-bonding at least resin particles of polyester resin and colorant particles, and a middle coating layer and an outermost coating layer formed by flocculating and fusion-bonding resin particles for coating the core particles, wherein a wax is added to the resin particles used for forming said core particles or said middle coating layer, and wherein the resin of the resin particles containing the wax is a polyester resin.

2. The electrostatic charge image developing toner of claim l, wherein the resin constituting said outermost coating layer has a glass transition point Tg of 55° C. or more.

3. The electrostatic charge image developing toner of claim l, wherein the resin of the resin particles containing wax used for forming said middle coating layer is a polyester resin.

4. The electrostatic charge image developing toner of claim 3, wherein an acid value of said polyester resin is in a range of 2 to 30 mg/KOH.

5. The electrostatic charge image developing toner of claim 3, wherein a volume average particle size (D4) of said resin particles containing wax is in the range of 80 to 200 nm.

6. The electrostatic charge image developing toner of claim 3, wherein the polyester resin used for said resin particles containing wax have a number average molecular weight (Mn) in the range of 2000 to 10000 and a value of weight average molecular weight (Mw)/number average molecular weight (Mn) in the range of 2 to 10.

7. The electrostatic charge image developing toner of claim 1, wherein resin particles of vinyl resin is additionally fusion-bonded to said core particles.

8. A production process of the electrostatic charge image developing toner of claim 1, comprising the steps of:

forming core particles by flocculating and fusion-bonding at least the resin particles of polyester resin and the colorant particles dispersed in fluid dispersion;

adding a dispersion including resin particles for forming a middle coating layer to a dispersion wherein the core particles are dispersed, and forming said middle coating layer by flocculating and fusion-bonding resin particles for forming the middle coating layer to the surface of the core particles; and adding a dispersion including resin particles for forming an outermost coating layer to a dispersion of core particles wherein said middle coating layer is formed, and forming said outermost coating layer by flocculating and fusion-bonding the resin particles for forming the outermost coating layer to the surface of the middle coating layer, wherein the resin particles containing wax are used as the resin particles for forming the core particles or the middle coating layer.

9. The production process of the electrostatic charge image developing toner of claim 8, wherein said resin particles containing wax are formed by the steps of: forming O/W type emulsion by emulsifying and dispersing a resin solution which at least the resin and the wax are added to non-soluble organic agent in a water-based medium; and removing the non water-soluble organic solvent from the O/W type emulsion.

10. The production process of the electrostatic charge image developing toner of claim 8, wherein the polyester resin is used as the resin particles for forming the core particles and/or the middle coating layer.

11. The method for production of the electrostatic charge image developing toner of claim 8, wherein the resin constituting said outermost coating layer has a glass transition point Tg of 55° C. or more.

12. The electrostatic charge image developing toner of claim 1, wherein the wax is added to the resin particles used for forming said core particles and said middle coating layer.

13. The production process of the electrostatic charge image developing toner of claim 8, wherein the resin particles containing wax are used as the resin particles for forming the core particles and the middle coating layer.

* * * * *